US005132004A

United States Patent [19]

van Haastrecht et al.

[11] Patent Number: 5,132,004

[45] Date of Patent: Jul. 21, 1992

[54] METHOD FOR THE MANUFACTURE OF A METAL-COATED STEEL STRIP AND STRIP PRODUCED BY THE METHOD

[75] Inventors: Gijsbertus C. van Haastrecht, Heemskerk; Jacob Miedema; Huig Bunk, both of Beverwijk, all of Netherlands

[73] Assignee: Hoogovens Groep AV, Ijmuiden, Netherlands

[21] Appl. No.: 527,296

[22] Filed: May 23, 1990

[30] Foreign Application Priority Data

Jun. 5, 1989 [NL] Netherlands ..... 8901414

[51] Int. Cl.[5] ..... C25D 5/50

[52] U.S. Cl. ..... 205/225; 205/224; 205/140; 204/210

[58] Field of Search ..... 204/37.1, 37.3, 28, 204/210; 205/225, 224, 140

[56] References Cited

U.S. PATENT DOCUMENTS 2,566,468 9/1951 Taylerson ..... 204/37.3

FOREIGN PATENT DOCUMENTS 672075 10/1963 Canada ..... 204/37.3

710815 6/1954 United Kingdom .

OTHER PUBLICATIONS

Hoare et al., "The Technology of Tinplate", Edward Arnold Ltd., London, 1965, pp. 242–243 and 284–288.

*Primary Examiner*—John Niebling
*Assistant Examiner*—Kishor Mayekar
*Attorney, Agent, or Firm*—Stevens, Davis, Miller & Mosher

[57] ABSTRACT

A method for the manufacture of a metal-coated steel strip with improved surface structure, wherein the strip is electrolytically coated with one or more metal coatings and the last-applied coating is temporarily melted by supplying heat to the strip (melting-on), is characterized in that the heat supplied to the strip for effecting the melting-on is generated at least in part by an electric current which is at all times non-zero. The heat supplied to effect the melting-on substantially continously compensates heat loss from the strip to the surroundings during the melting-on, and may for example be generated by electrical resistance heating using only a direct current or using an alternating current on which is superimposed a direct current. The strips produced are free of the so-called woodgrain effect.

6 Claims, No Drawings

METHOD FOR THE MANUFACTURE OF A METAL-COATED STEEL STRIP AND STRIP PRODUCED BY THE METHOD

FIELD OF THE INVENTION

The invention relates to a method for the manufacture of a metal-coated steel strip having improved surface structure, more particularly to a method in which the steel strip is provided electrolytically with one or more metal coatings, and the last applied coating is temporarily melted by supplying heat to the strip. This latter step is known as "melting-on" and the method is known per se from Dutch patent application 7612517. The invention relates also to metal-coated steel strips manufactured in accordance with the method of the invention and to an apparatus for carrying out the new method.

BACKGROUND OF THE INVENTION AND PRIOR ART

To increase corrosion resistance, to enhance the appearance of the surface and for the benefit of any further processing, steel strips are often coated electrolytically with tin, chromium or another metal. The application onto a steel strip of successive layers of different metals is also known.

As a basic material are normally used steel strips which are obtained by the following processes: hot rolling, pickling, cold rolling, cleaning, annealing and temper rolling. For electrolytic application of a coating the following processes are also carried out: de-greasing, pickling, electrolytic coating one or more times, possibly applying a flux material, melting-on of the top coating and post-treatment. Here the fluxing process is intended to create good flow of the last-applied coating during the subsequent melting-on process. All this has the purpose of obtaining a strip of shiny appearance and possibly also to improve the adhesion of the coating material to the steel substrate.

It should be noted that some of the various processes mentioned above may be carried out in combination or omitted without any effect on the essence of the invention.

As a rule melting-on of the outer coating takes place in a vertical melting-on tower through which the strip is vertically fed successively upwards and downwards. Such towers are well known in the art and are described in, for example, W. E. Hoare et. al. "The Technology of Tinplate", 1965, pages 242–243, Edward Arnold (Publishers) Ltd., London. The melting-on takes place by the strip being heated, for example by high frequency electrical induction heating and/or electrical resistance heating, to above the melting point of the outer coating.

With the known methods difficulties can arise with respect to the appearance of the coated strip after melting-on. A particular problem is that of the surface of the strip after melting-on displaying the so-called woodgrain effect (German="Holzmaserung"). This effect is described in W. E. Hoare et. al. "The Technology of Tinplate" (supra), pages 284–288. This effect is known to occur particularly where alternating current resistance heating is used in the melting-on process for heating the strip, but it may also occur when other forms of heating are used, for example high frequency electrical induction heating.

In United Kingdom Patent GB-A-710815 there is described an apparatus for the melting-on of a metallic coating of a wire or strip, the apparatus comprising a first heater for generating part of the necessary heat for the melting-on by alternating current resistance heating and an additional heater for supplying the remaining necessary heat directly to a small zone of the wire or strip to complete the melting-on in that zone. The woodgrain effect is not mentioned.

Dutch patent application 7612517 proposes that in at least the section of the steel strip in which the temperature of the last-applied coating increases by 20° towards its melting point, an atmosphere is maintained in which the concentration of $O_2$ is lower than that of the surrounding air by a factor of at least 7. However, it has been found that this measure does not adequately prevent the woodgrain effect in all cases.

SUMMARY OF THE INVENTION AND DESCRIPTION OF EMBODIMENTS

An object of the present invention is to further combat the woodgrain effect. To this end the method in accordance with the invention is characterized in that the heat supplied to the strip for effecting the temporary melting of the last-applied coating is generated at least in part by an electric current which is at all times non-zero, so that the heat supplied to the strip for effecting the temporary melting of the last applied coating substantially continuously compensates the heat loss from the strip to the surroundings during the temporary melting of the last-applied coating.

It has been found that with the method in accordance with the invention a woodgrain-free product may be obtained. It has been realised by the present inventors that with an alternating current commonly used for heating the steel strip, e.g. by electrical resistance heating or high-frequency induction heating, around the passage through zero of the alternating current, the heat loss from the strip to the surroundings is sufficiently great to cause solidification in the region of the coating just melted and this produces a dull line (the woodgrain effect) in the finished product.

One solution to this woodgrain problem is to not use an alternating current at all for heating the strip, but rather to use only a direct current. Another possibility is to superimpose on the alternating current a direct current which is sufficiently high to compensate the heat loss from the strip to the surroundings at least during the passage of the alternating current through zero.

In another embodiment of the method in accordance with the invention, a direct current is used to generate heat for adjusting the ambient temperature of the strip in the region where melting-on takes place to a value substantially equal to the melting temperature of the coating to be melted-on. An inexpensive practical embodiment of an apparatus for carrying out this method is an apparatus which comprises a direct-current heat generator for heating the direct surroundings of the strip in the region of the melting-on.

Besides the methods and apparatus described above, the invention also relates to steel strips manufactured in accordance with the methods. These metal strips stand out from equivalent products manufactured in accordance with known methods, in that they are substantially completely free of the woodgrain effect.

What is claimed is:

1. A method for the manufacture of a metal-coated steel strip having improved surface structure, wherein said strip is electrolytically coated with one or more metal coatings, and a coating which is the last-applied coating is temporarily melted in an environment by supplying heat to said strip, and wherein said heat supplied to said strip for effecting said temporary melting of said last-applied coating is generated at least in part by an electric current which is at all times non-zero, so that said heat supplied to said strip for effecting said temporary melting of said last applied coating substantially continuously compensates loss of said heat from said strip to said environment during said temporary melting of said last-applied coating.

2. The method according to claim 1, wherein heat supplied to said strip is generated by electrical resistance heating using only a direct current.

3. The method according to claim 1, wherein heat supplied to said strip is generated by electrical resistance heating using an alternating current, said alternating current periodically passing through zero, there being superimposed on said alternating current a direct current which is sufficiently high to compensate loss of said heat from said strip to said environment at least during said passage of said alternating current through zero.

4. The method according to claim 1, wherein heat supplied to said strip is generated by means of high frequency induction heating using an alternating current, said alternating current passing periodically through zero, and also by means of a direct current which is sufficiently high to compensate loss of said heat from said strip to said environment at least during said passage of said alternating current through zero.

5. The method according to claim 1 wherein said last-applied coating has a melting temperature and wherein a region of said environment in which said temporary melting of said last-applied coating takes place has an ambient temperature, wherein a direct current is used to generate heat for adjusting said ambient temperature to a value substantially equal to said melting temperature of said last-applied coating.

6. An apparatus for manufacturing a metal-coated steel strip, comprising means for supplying heat, in an environment, to a metal-coated steel strip having one or more metal coatings to temporarily melt a coating which is the last-applied coating, wherein said apparatus further includes a direct-current heat generator for heating said environment in a region of said temporary melting of said last-applied coating.

* * * * *